US010538370B2

(12) United States Patent
Hatamian et al.

(10) Patent No.: US 10,538,370 B2
(45) Date of Patent: Jan. 21, 2020

(54) AUTOMATIC CONTAINER STOPPER AND OPENER

(71) Applicants: Mehdi Hatamian, Mission Viejo, CA (US); Kamran Ghobadi, Irvine, CA (US)

(72) Inventors: Mehdi Hatamian, Mission Viejo, CA (US); Kamran Ghobadi, Irvine, CA (US)

( * ) Notice: Subject to any disclaimer, the term of this patent is extended or adjusted under 35 U.S.C. 154(b) by 453 days.

(21) Appl. No.: 15/405,243

(22) Filed: Jan. 12, 2017

(65) Prior Publication Data

US 2017/0129664 A1 May 11, 2017

Related U.S. Application Data

(63) Continuation-in-part of application No. 14/751,712, filed on Jun. 26, 2015, now Pat. No. 9,994,367.
(Continued)

(51) Int. Cl.
*B65D 51/24* (2006.01)
*B65D 39/08* (2006.01)
(Continued)

(52) U.S. Cl.
CPC ..... *B65D 51/243* (2013.01); *B65D 1/023* (2013.01); *B65D 39/0058* (2013.01);
(Continued)

(58) Field of Classification Search
CPC .. B67B 1/00; B67B 1/04; B67B 1/045; B67B 6/00; B65D 39/0052; B65D 39/0058;
(Continued)

(56) References Cited

U.S. PATENT DOCUMENTS 456,257 A * 7/1891 Haigh ..... B65D 39/12 215/360
605,125 A * 6/1898 Nutt ..... B65D 39/12 215/360
(Continued)

FOREIGN PATENT DOCUMENTS

DE 3231140 A1 * 2/1984 ..... B65D 39/12
DE 3525329 A1 * 4/1987 ..... B60R 25/043
(Continued)

*Primary Examiner* — Stephen F. Gerrity
(74) *Attorney, Agent, or Firm* — Genius Patent APC; Bruce Hare

(57) ABSTRACT

An automated stopper and opener includes: a sleeve housing that is able to fit within a neck of a container; a mechanical feature that is able to vary a force applied to an internal surface of the sleeve such that a seal is able to be formed or released within the neck of the container; and an electronic controller that is able to manipulate the force applied to the internal surface of the sleeve by at least partly directing operations of the mechanical feature. An automated stopper includes: a cylindrical sleeve; a mechanical element that fits within the cylindrical sleeve and has a variable outer diameter; a communication interface that is able to receive commands from a user device; and a controller that is able to interpret the received commands and direct the mechanical element to control the variable outer diameter. A system includes automated stoppers and a user device.

19 Claims, 11 Drawing Sheets

Related U.S. Application Data

(60) Provisional application No. 62/169,944, filed on Jun. 2, 2015.

(51) Int. Cl.
*B65D 39/00* (2006.01)
*B65D 1/02* (2006.01)
*B65D 39/12* (2006.01)
*G08C 17/02* (2006.01)

(52) U.S. Cl.
CPC ..... *B65D 39/0064* (2013.01); *B65D 39/08* (2013.01); *B65D 39/12* (2013.01); *G08C 17/02* (2013.01); *G08C 2201/30* (2013.01)

(58) Field of Classification Search
CPC .... B65D 39/0064; B65D 39/12; B65D 39/16; B65D 51/24; B65D 51/243
USPC ..... 53/381.4; 215/228, 355, 358, 359, 360, 215/361, 364
See application file for complete search history.

(56) References Cited

U.S. PATENT DOCUMENTS 1,416,278 A * 5/1922 Furman ..... B65D 39/12 215/360
1,455,978 A * 5/1923 Wentz ..... B65D 39/12 215/215
2,633,763 A * 4/1953 Sperling ..... B23B 47/28 269/49
2,732,106 A * 1/1956 Harland ..... B65D 39/12 215/360
3,213,845 A * 10/1965 Blahut et al. ..... B24B 53/04 125/11.15
5,334,213 A * 8/1994 Price, Jr. ..... A61F 2/142 606/166
6,536,618 B1 * 3/2003 Hwang et al. ..... B24B 53/04 125/11.15
7,267,250 B2 * 9/2007 Rudduck et al. ..... B65D 39/12 222/1
7,743,796 B1 * 6/2010 Schooley ..... B65D 39/0052 141/351
8,123,054 B2 2/2012 Smith
9,637,367 B1 * 5/2017 Arnold ..... B67B 7/0405
2003/0168424 A1 * 9/2003 Permuy ..... B65D 39/12 215/360
2004/0112856 A1 * 6/2004 Hwang et al. ..... B65D 39/0076 215/361
2009/0102664 A1 * 4/2009 Puccini ..... B65D 39/0058 340/572.7
2015/0053702 A1 * 2/2015 Brewster et al. .. A47G 19/2211 220/703
2015/0060389 A1 * 3/2015 Bolger ..... B65D 39/12 215/360
2016/0214772 A1 * 7/2016 Luzaich ..... B65D 51/244
2016/0313167 A1 * 10/2016 Li ..... B65D 1/0207
2017/0275057 A1 * 9/2017 Gonzalez Valencia et al. ..... B65D 39/12
2017/0341822 A1 * 11/2017 Essebbar ..... B65D 39/00

FOREIGN PATENT DOCUMENTS

EP 0807584 A1 11/1997
FR 395770 A * 3/1909 ..... B65D 39/12
FR 549245 A * 2/1923 ..... B65D 39/12
FR 2594501 A1 * 8/1987 ..... B65D 39/12
FR 2788035 A1 * 7/2000 ..... B65D 39/00
GB 414254 A * 8/1934 ..... B65D 39/12
GB 1276485 A * 6/1972 ..... B65D 39/12
WO 9520527 A1 8/1995

* cited by examiner

AUTOMATIC CONTAINER STOPPER AND OPENER

BACKGROUND

Many products such as beverages or other liquids may be stored in bottles or similar containers. Such containers may typically include a stopper such as a cork or cap that may retain the contents within the container when closed and release the contents when open. Some containers may allow variable sealing pressure associated with the contents (e.g., carbonated water, flat water, etc.), the stopper material, the container type or material, and/or other relevant factors.

Currently, most containers must be opened manually, such as by using a corkscrew. Such an approach may cause damage to the stopper, such as by improper insertion of a corkscrew into a cork stopper and/or misalignment between the corkscrew axis and cork stopper axis.

In addition, current solutions do not allow for controllable sealing pressure and must be inserted or removed using separate dedicated tools or apparatus. Further, existing solutions require physical manipulation by a user and do not provide self-actuated capabilities. Finally, existing solutions require manual intervention to operate and do not allow for wireless or remote control.

Accordingly, there is a need for a stopper with controllable sealing pressure that is able to self-actuate and allows for various control pathways.

SUMMARY

Some embodiments provide an automated container stopper and opener device that may be able to seal and/or open bottles and containers with a round or elliptical opening. The device may be used on various types of bottles and containers (e.g., wine and champagne bottles where having a cork sealer is a necessity, carbonated beverage containers, etc.).

The stopper and opener device may include a sleeve (or "seal" or "plug") that houses various elements of the device and is able to generate a seal within a container neck. The sleeve may include materials such as cork, rubber, plastic, etc. In some embodiments, the sleeve may have a cylindrical shape that is open at one end. Some embodiments may include a sleeve that completely encloses the various other components of the device.

Within the sleeve, the stopper and opener device may include various mechanical components that are able to apply pressure to the sleeve (and/or release pressure therefrom) in order to close or seal a container (and/or to open or "pop" the container).

The stopper and opener device may include various electronic components that are able to control the operation of the mechanical components, measure and/or analyze data regarding the container and/or contents, provide user interface features, allow communication with external devices and/or systems, and/or perform other appropriate operations.

The preceding Summary is intended to serve as a brief introduction to various features of some exemplary embodiments. Other embodiments may be implemented in other specific forms without departing from the scope of the disclosure.

BRIEF DESCRIPTION OF THE SEVERAL VIEWS OF THE DRAWINGS

The exemplary features of the disclosure are set forth in the appended claims. However, for purpose of explanation, several embodiments are illustrated in the following drawings.

DETAILED DESCRIPTION

The following detailed description describes currently contemplated modes of carrying out exemplary embodiments. The description is not to be taken in a limiting sense, but is made merely for the purpose of illustrating the general principles of some embodiments, as the scope of the disclosure is best defined by the appended claims.

Various features are described below that can each be used independently of one another or in combination with other features. Broadly, some embodiments generally provide an automated container stopper and opener.

A first exemplary embodiment provides an automated stopper and opener comprising: a sleeve housing that is able to fit within a neck of a container; a mechanical feature that is able to vary a force applied to an internal surface of the sleeve such that a seal is able to be formed or released within the neck of the container; and an electronic controller that is able to manipulate the force applied to the internal surface of the sleeve by at least partly directing the operations of the mechanical feature.

A second exemplary embodiment provides an automated stopper comprising: a cylindrical sleeve; a mechanical element that fits within the cylindrical sleeve and has a variable outer diameter; a communication interface that is able to receive commands from a user device; and a controller that is able to interpret the received commands and direct the mechanical element in order to control the variable outer diameter.

A third exemplary embodiment provides a system for opening a set of beverage containers, the system comprising: a user device able to communicate across at least one wireless pathway; and a plurality of beverage containers, each beverage container having an automated stopper comprising: a cylindrical sleeve; a mechanical element that fits within the cylindrical sleeve and has a variable outer diameter; a communication interface that is able to receive commands from the user device; and a controller that is able to interpret the received commands and direct the mechanical element in order to control the variable outer diameter.

Several more detailed embodiments are described in the sections below. Section I provides a description of a manual stopper and opener of some embodiments. Section II then describes exemplary automated stoppers and openers of some embodiments. Next, Section III describes a hardware architecture of some embodiments. Section IV then describes various methods of operation used by some embodiments. Lastly, Section V describes a computer system which implements some of the embodiments.

I. Manual Stopper and Opener

Figure 1:
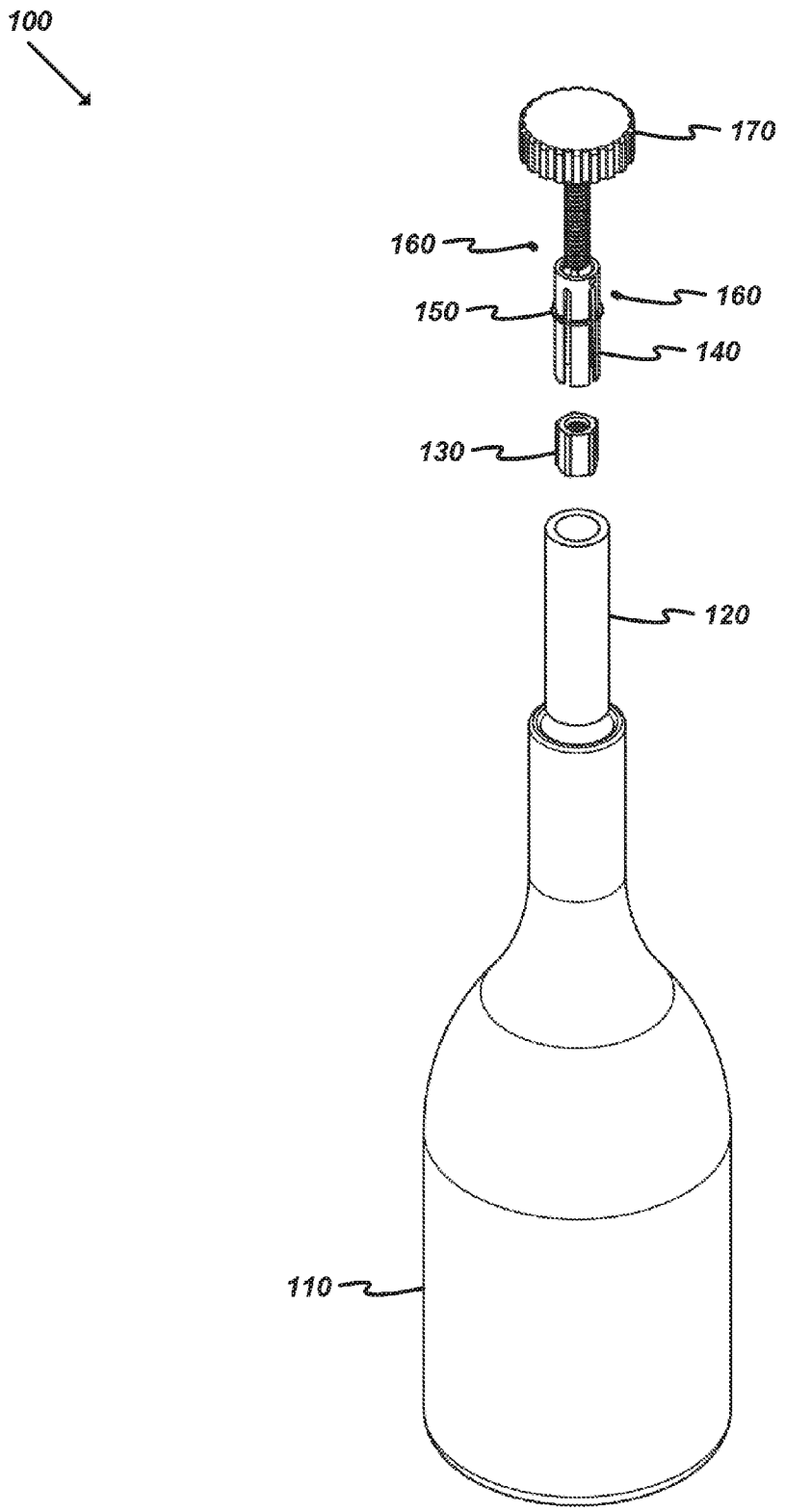
FIG. 1 illustrates an exploded front, top perspective view of a manual stopper and opener according to an exemplary embodiment.

FIG. 1 illustrates an exploded front, top perspective view of a manual stopper and opener 100 according to an exemplary embodiment. In this example, the container 110 is a round bottle with a round neck (e.g., a wine bottle). As shown, the stopper and opener may include a sleeve or plug 120, a nut 130, a guide 140, a circumferential ridge 150, set screws 160, and a knob 170.

Figure 2A:
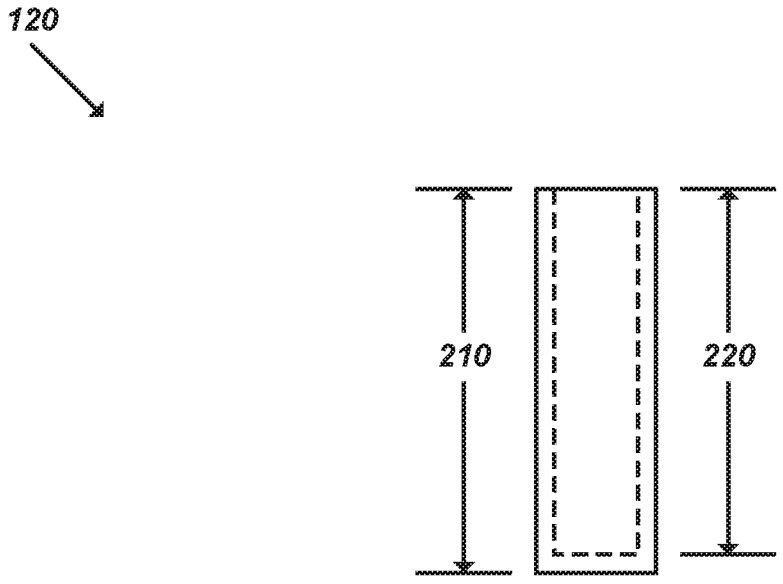
FIG. 2A illustrates a front elevation view of a sleeve of the manual stopper and opener of some embodiments.
Figure 2B:
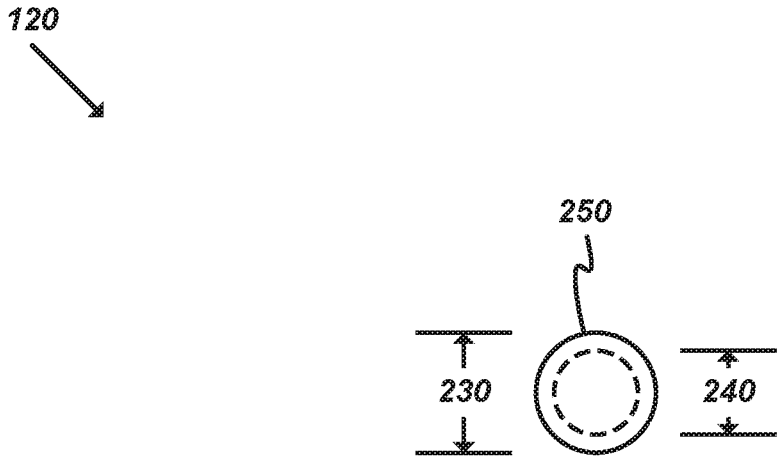
FIG. 2B illustrates a top view of the sleeve of FIG. 2A.

FIG. 2A illustrates a front elevation view of a sleeve 120 of the manual stopper and opener 100. FIG. 2B illustrates a top view of the sleeve 120. As shown, the sleeve may have a length 210, a depth 220, an outer diameter 230, an inner diameter 240, and an outer surface 250.

The sleeve 120 may be made from various appropriate materials, such as cork, rubber, plastic, etc. Such materials may generally be flexible and able to generate a water tight (or air tight) seal against the neck of a container. In some embodiments, the sleeve may include a lip or other retaining element at the top to prevent the sleeve from falling into the container.

The sleeve may be sized such that the depth 220 and diameter 240 of the interior cavity of the sleeve 120 matches the length and diameter of the guide 140. The outer diameter of the sleeve 230 may be sized such that the sleeve is able to fit within the container neck.

Figure 3A:
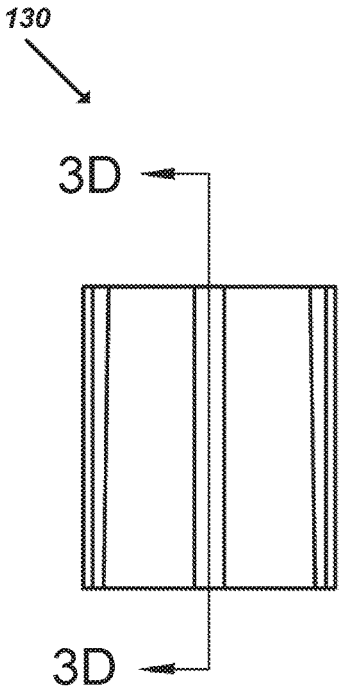
FIG. 3A illustrates a front elevation view of a nut of the manual stopper and opener of some embodiments.
Figure 3B:
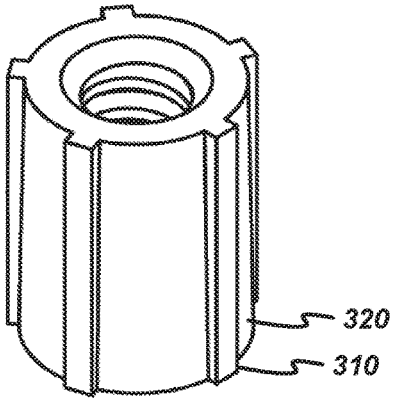
FIG. 3B illustrates a front, top perspective view of the nut of FIG. 3A.
Figure 3C:
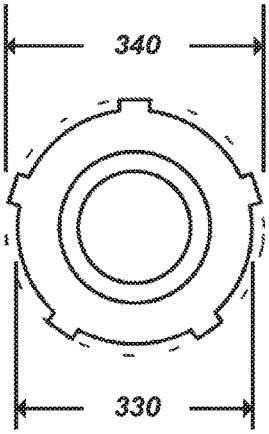
FIG. 3C illustrates a top view of the nut of FIG. 3A.
Figure 3D:
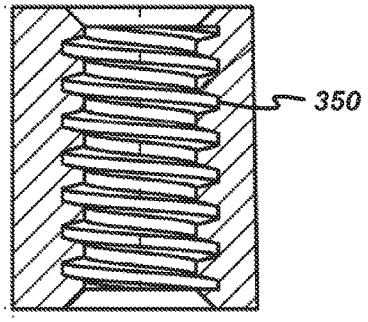
FIG. 3D illustrates a section view of the nut of FIG. 3A along line 3D-3D.

FIG. 3A illustrates a front elevation view of a nut 130 of the manual stopper and opener 100. FIG. 3B illustrates a front, top perspective view of the nut 130. FIG. 3C illustrates a top view of the nut 130. FIG. 3D illustrates a section view of the nut 130 along line 3D-3D. As shown, the nut 130 may include a number of protruding ridges 310 and associated grooves 320. The nut 130 may have an outer diameter 330 associated with the grooves 320 and an outer diameter 340 associated with the ridges 310. The nut 120 may include a threaded cavity 350.

The nut 130 may be sized such that the outer diameter 340 is able to fit within the cavity of the sleeve 120. In addition, the nut 130 may be able to fit within guide 140. The threaded cavity 350 may be able to receive at least a portion of the knob 170.

Figure 4A:
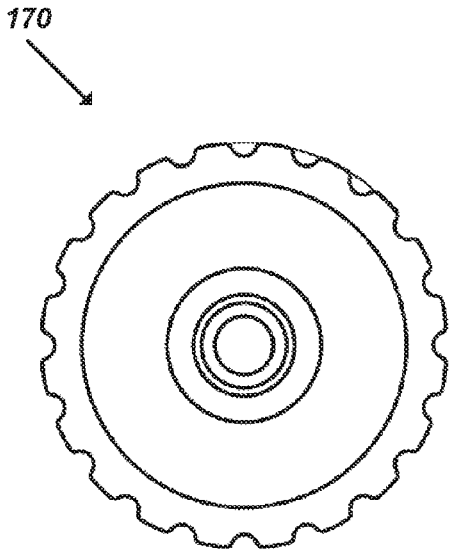
FIG. 4A illustrates a bottom view of a knob of the manual stopper and opener of some embodiments.
Figure 4B:
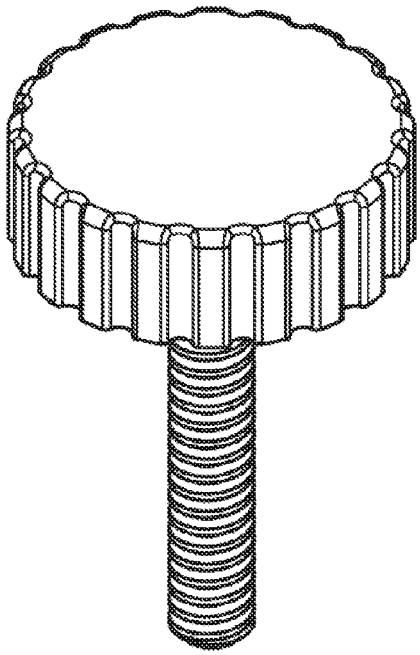
FIG. 4B illustrates a front, top perspective view of the knob of FIG. 4A.
Figure 4C:
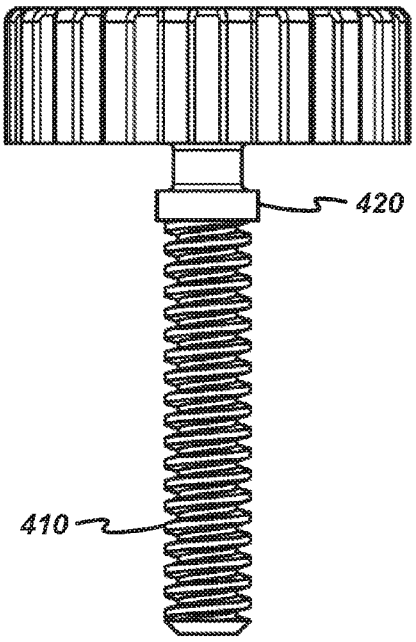
FIG. 4C illustrates a front view of the knob of FIG. 4A.

FIG. 4A illustrates a bottom view of a knob 170 of the manual stopper and opener 100. FIG. 4B illustrates a front, top perspective view of the knob 170. FIG. 4C illustrates a front view of the knob 170. As shown, the knob may include a threaded member 410 and a sleeve portion 420.

At least a portion of the threaded member 410 may be able to fit within the threaded cavity 350 of the nut 130. The sleeve portion 420 may allow the knob 170 to be retained within the sleeve 120 using the set screws 160. The sleeve portion 420 may allow the threaded portion 410 to rotate while the sleeve portion 420 is held in place.

Figure 5A:
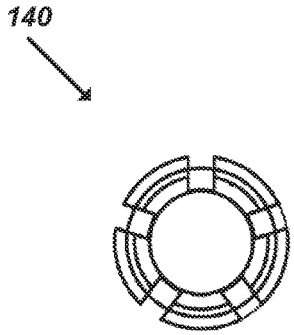
FIG. 5A illustrates a top view of a guide of the manual stopper and opener of some embodiments.
Figure 5B:
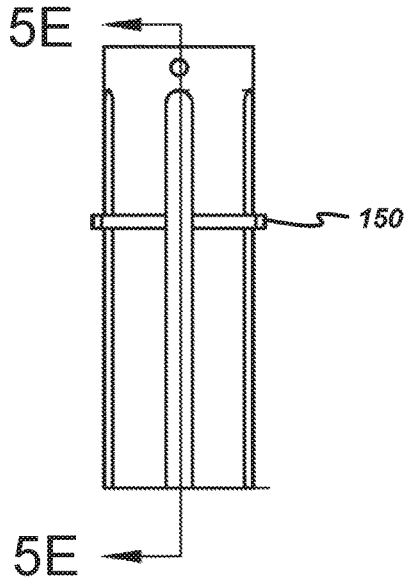
FIG. 5B illustrates a front view of the guide of FIG. 5A.
Figure 5C:
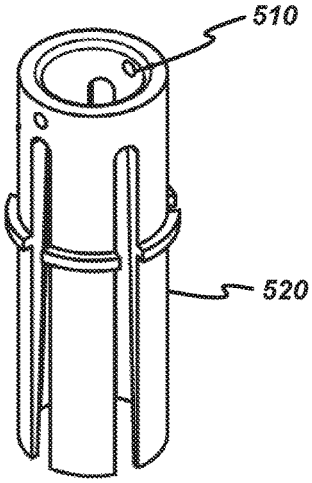
FIG. 5C illustrates a front, top perspective view of the guide of FIG. 5A.
Figure 5D:
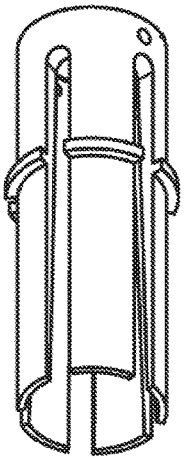
FIG. 5D illustrates a front, bottom perspective view of the guide of FIG. 5A.
Figure 5E:
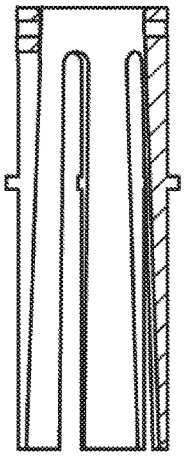
FIG. 5E illustrates a section view of the guide of FIG. 5A along line 5E-5E.

FIG. 5A illustrates a top view of a guide 140 of the manual stopper and opener 100. FIG. 5B illustrates a front view of the guide 140. FIG. 5C illustrates a front, top perspective view of the guide 140. FIG. 5D illustrates a front, bottom perspective view of the guide 140. FIG. 5E illustrates a section view of the guide 140 along line 5E-5E. As shown, the guide 140 may include a protruding ridge 150, threaded holes 510, and fingers 520 (with associated "slots" between the fingers).

The guide 140 may be sized such that the protruding ridge 150 may fit within the inner diameter 240 of sleeve 120. The guide 140 may further be sized such that nut 130 is able to fit within the guide 140, with the ridges 310 of the nut 130 able to be received by the slots between fingers 520. In addition, the guide 140 may receive a portion of the knob 170. The knob may include a threaded shaft 410. The threaded shaft may fit within the guide 140, with the set screws 160 being positioned within holes 510 such that a portion of the knob 170 is secured to the guide 140 such that the position of the knob 170 relative to a linear axis of the guide 140 does not change during use. The portion of the knob 170 secured by the set screws 160 may allow the top and threaded portion 410 of the knob 170 to rotate relative to the guide 140.

During operation, the knob 170 may be turned (e.g., in a clockwise direction) to pull the nut 130 upwards toward the top of the guide 140, gradually opening the fins 520 on the guide channel 140 exerting increasing pressure on the inside wall of the sleeve 120 as the nut 130 moves up.

Depending on the container attributes, the outside diameter of the sleeve 120 may be such that the sleeve easily fits in the opening of the container with very small amount of pressure (so that the sleeve does not fall into the container). Once the sleeve is placed in the neck of the container, turning the knob 170 applies pressure from inside the sleeve 120 and seals the container. Likewise, turning the knob 170 in the opposite direction (e.g., counter clockwise) the pressure applied from inside the sleeve 120 is removed and the sleeve may be loosened and removed to open the container.

One exemplary application of device 100 is sealing wine bottles. The wine industry and wine manufacturers across the world use only cork for sealing their bottles and do not accept any other material. As such, a device 100 with a cork sleeve 120 provides the same cork-based seal with the added advantage that the bottle may easily be opened by turning the top knob 170 without the need for a corkscrew or other opener. Furthermore, after partial use of the contents of the bottle, the device 100 may be used to re-seal the bottle in exactly the same way as was done originally when the wine was made and bottled. In cases where a wine bottle uses a conventional cork that is opened with a wine opener, device 100 may be used to re-seal a bottle to preserver any unused portion of the contents.

II. Automated Stopper and Opener

Figure 6:
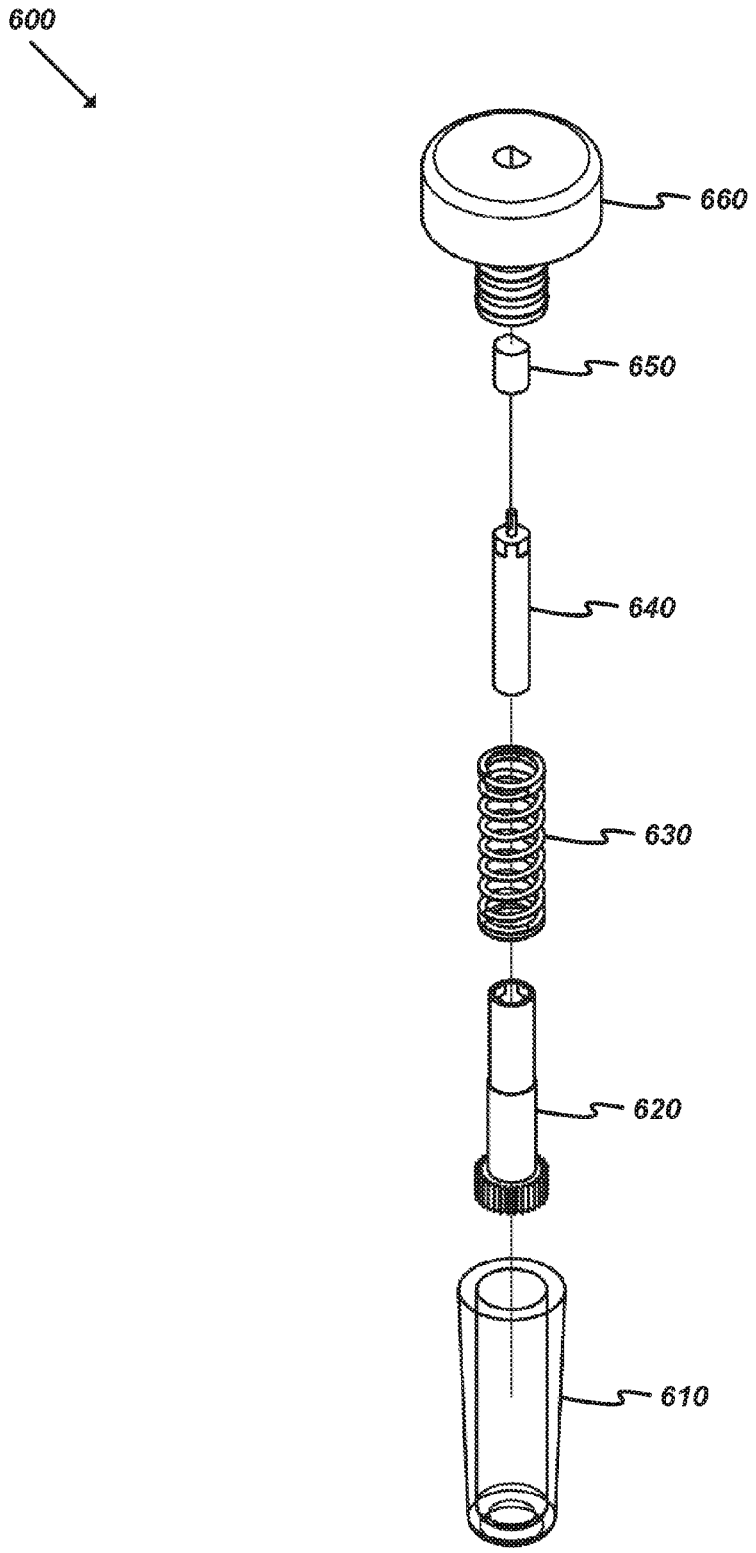
FIG. 6 illustrates an exploded front, top perspective view of an automated stopper and opener according to an exemplary embodiment.

FIG. 6 illustrates an exploded front, top perspective view of an automated stopper and opener 600 according to an exemplary embodiment. As shown, the stopper and opener may include a sleeve 610, a sealing element 620, a spring 630, a motor 640, a power source 650, and a top cap 660.

The sleeve 610 may be similar to sleeve 120 described above. In this example, the sleeve may have a slight conical taper rather than a purely cylindrical shape. Such an approach may allow the sealing element 620 to create a tighter seal as the sealing element moves along the linear axis of the sleeve 610 toward the thicker taper.

The sealing element 620 may be generally cylindrical, with a protruding portion at one end. The sealing element may include a cavity, which may be threaded or otherwise allow the sealing element to be positioned relative to the sleeve 610.

The spring 630 or other resistance element may exert force on the sealing element 620. Such force may help release the seal as the sealing element 620 moves toward the thinner taper of the sleeve 610.

The motor 640 may be able to turn a threaded element and/or otherwise may be able to move the sealing element 620 in either direction along the linear axis.

The power source 650 may include a battery or other appropriate storage element. The power source may include other electronics that may be utilized by the device 600. Examples of such elements will be described in more detail below in reference to FIG. 8.

The top cap 660 may allow a user to grasp and insert the device 600 into a container and/or extract the device from a container.

Figure 7:
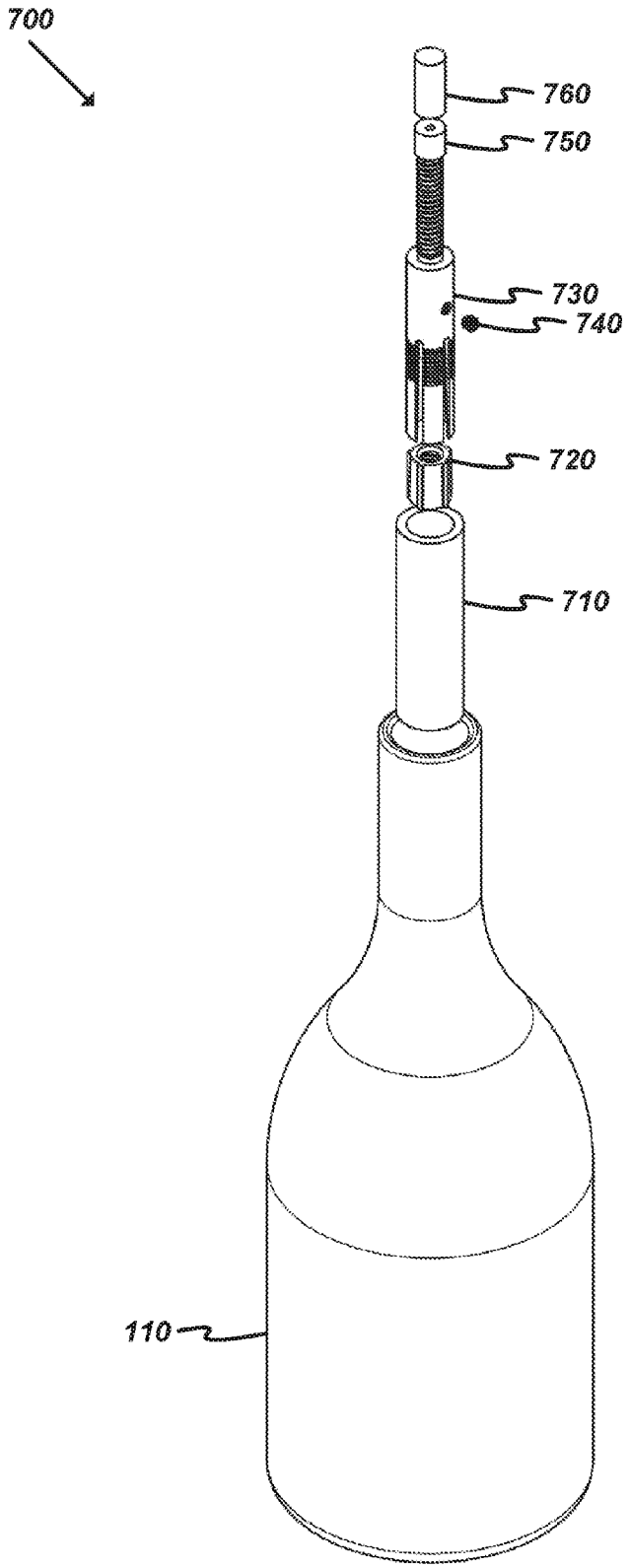
FIG. 7 illustrates an exploded front, top perspective view of an alternative automated stopper and opener according to an exemplary embodiment.

FIG. 7 illustrates an exploded front, top perspective view of an alternative automated stopper and opener 700 according to an exemplary embodiment. As shown, the stopper and opener 700 may include a sleeve 710, a nut 720, a guide 730, a set screw 740, a threaded member 750, and an electronics module 760.

The sleeve 710, nut 720, guide 730, and set screw 740 may be similar to those elements described above in reference to device 100.

The threaded member 750 may be a cylindrical element with a threaded exterior surface that matches a threaded cavity of the nut 720.

The electronics module 760 may include electronic circuitry, mechanical actuators and/or motors, and/or other elements that may be utilized by the device 700. Examples of such elements will be described in more detail below in reference to FIG. 8.

The automated devices 600 and 700 may include similar mechanical elements as described above embedded in the device. The screw may be driven by an electric motor that is also embedded inside the device along with the battery and all the necessary electronics. The motor can be activated either through a pressure switch at the top of the device or through a wireless link (e.g., Bluetooth, WiFi, etc.).

Some embodiments may include other ways of sealing and/or opening the stopper. For instance, some single-use embodiments may include a small charge that is able to activate a seal and/or release feature.

In the wireless version of the cork, the commands to activate the motor (in either open or close directions) may be initiated from an external device such a mobile phone, electronic tablet, laptop, desktop, or any other device equipped with a transmitter compatible with the embedded receiver inside the automated stopper and opener of some embodiments.

While devices 600 and 700 may be used on any container, one specific example use is champagne bottles where the popping of the champagne can take place under the control of a remote device. With this capability many possibilities and uses open up including convenience for the consumers, entertainment applications, and advertising. Once the remote popping mechanism is provided, the triggering of the popping action can be achieved many different ways including time-activated, voice activated, music-activated, face-recognition activated, event detection activated, and numerous other possibilities all controlled via the software on the external device such as an app for a mobile phone or tablet. Multiple champagne bottles can also be popped according to a sequence defined by the software which can be a mix of different activation mechanisms mentioned above.

III. Hardware Architecture

Figure 8:
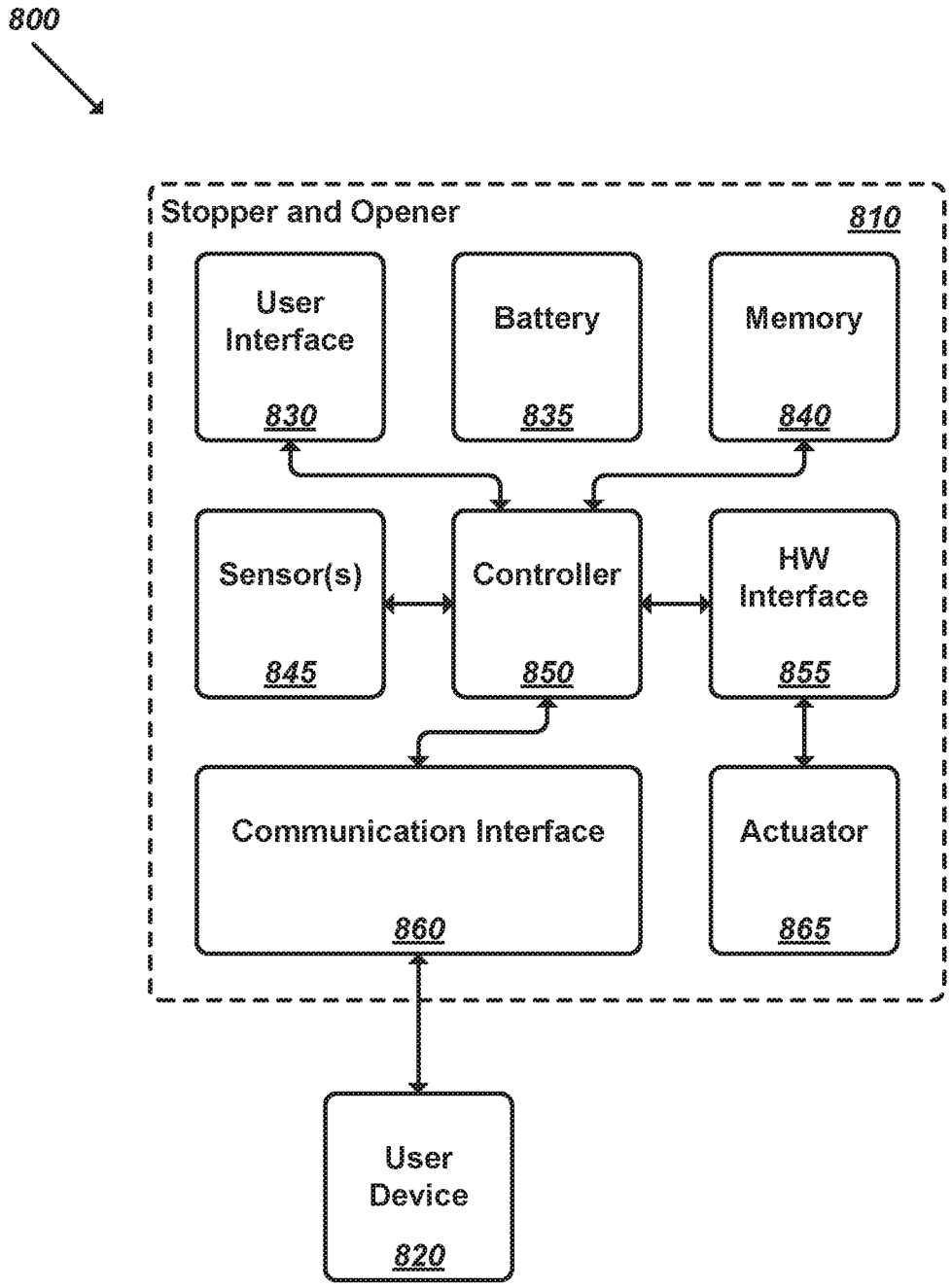
FIG. 8 illustrates a schematic block diagram of a system including an automated stopper and opener according to an exemplary embodiment.

FIG. 8 illustrates a schematic block diagram of a system 800 including an automated stopper and opener 810 according to an exemplary embodiment. Such components may be included in a stopper and opener such as automated stopper and opener 600 or 700. As shown, the system 800 may include one or more automated stopper and openers 810 and one or more user devices 820.

The user device 820 may be a computing device that is able to wirelessly communicate with the stopper and opener 810. The user device 820 may be, for instance, a smartphone, tablet, laptop, server, wearable device, etc.

As shown, the automated stopper and opener 810 may include a user interface module 830, a battery 835, a memory 840, one or more sensors 845, a controller 850, a hardware interface 855, a communication interface 860, and an actuator 865.

The user interface module 830 may include various electronic elements that may allow user interactions. Such elements may include, for instance, pushbuttons or other controls, display elements (e.g., LEDs or other indicators), etc. The user interface module may allow a user to control the automated device 810 without using any external user device 820.

The battery 835 or other power source may be able to store power for use by the various elements of the stopper and opener 810. To preserve battery life during storage life of the bottle, the battery 835 may have an engagement mechanism which is activated when the wrapping paper seal on top of the bottle is opened by the consumer (and/or may be activated based on other actions or received inputs). Once activated, the battery may be able to last for multiple uses of motor activation for reinsertion or removal. In the champagne popping application, the battery may only provide enough charge for one activation to pop the bottle open.

The memory 840 may include various instructions and/or other data that may be used by the other elements of device 810. Such data and instructions may include various thresholds, operating parameters, etc.

The sensors 845 may include various electronic elements able to determine various parameters associated with the device 810 or use thereof. For instance, some embodiments may include one or more pressure sensors that are able to measure the pressure applied to the sides of a sleeve of some embodiments (and also to the container neck outside the sleeve). As another example, some embodiments may measure the pressure of a stored liquid (e.g., a carbonated beverage) to determine whether the contents of a container are still fresh or usable. Sensors 845 may include pressure sensors, vacuum sensors, light sensors, accelerometers, temperature sensors, etc. Such sensors may allow a user to determine, for instance, whether a beverage has chilled sufficiently to be served, whether the contents of a container are fresh, etc.

The controller 850 may be able to execute various instructions and/or otherwise process data and/or commands. The controller may be able to at least partly direct the operations of various other components of device 810.

The hardware interface 855 may allow the device 810 to direct or otherwise control the operations of various hardware elements (e.g., motors, actuators, etc.). The hardware interface 855 may also be able to retrieve, receive, and/or otherwise act on feedback from the hardware elements. For instance, a motor may include a pressure sensor, torque sensor, and/or other appropriate element that may be able to provide feedback as to whether the device is secured within a bottle, in an open state, etc. The hardware elements may include various appropriate components or combinations of components. For instance, some embodiments may include a motor that powers an air pump that inflates a balloon inside a sleeve of some embodiments.

The communication interface 860 may allow the device 810 to interact with various external components such as user device 820. The communication interface 860 may generally use wireless communication links (e.g., Bluetooth, WiFi, etc.). Such links may include one or more networks (e.g., local area networks, wireless networks, distributed networks such as the Internet, etc.), as appropriate.

The motor or actuator 865 may include various physical elements that are able to manipulate the device 810 such that a seal is attained or released. For instance, in the examples above, a rotary motor may allow a threaded member to be inserted into a nut or removed from the nut.

One of ordinary skill in the art will recognize that the device 810 may include various other elements that allow for other applications such as controlling LED lighting, generating audio sounds and music, embedding electronic tags, embedding a microphone, etc. Such elements may be controllable via software and the device 810 may provide a general purpose way to add such capabilities to any sealable container with a round neck.

IV. Methods of Operation

Figure 9:
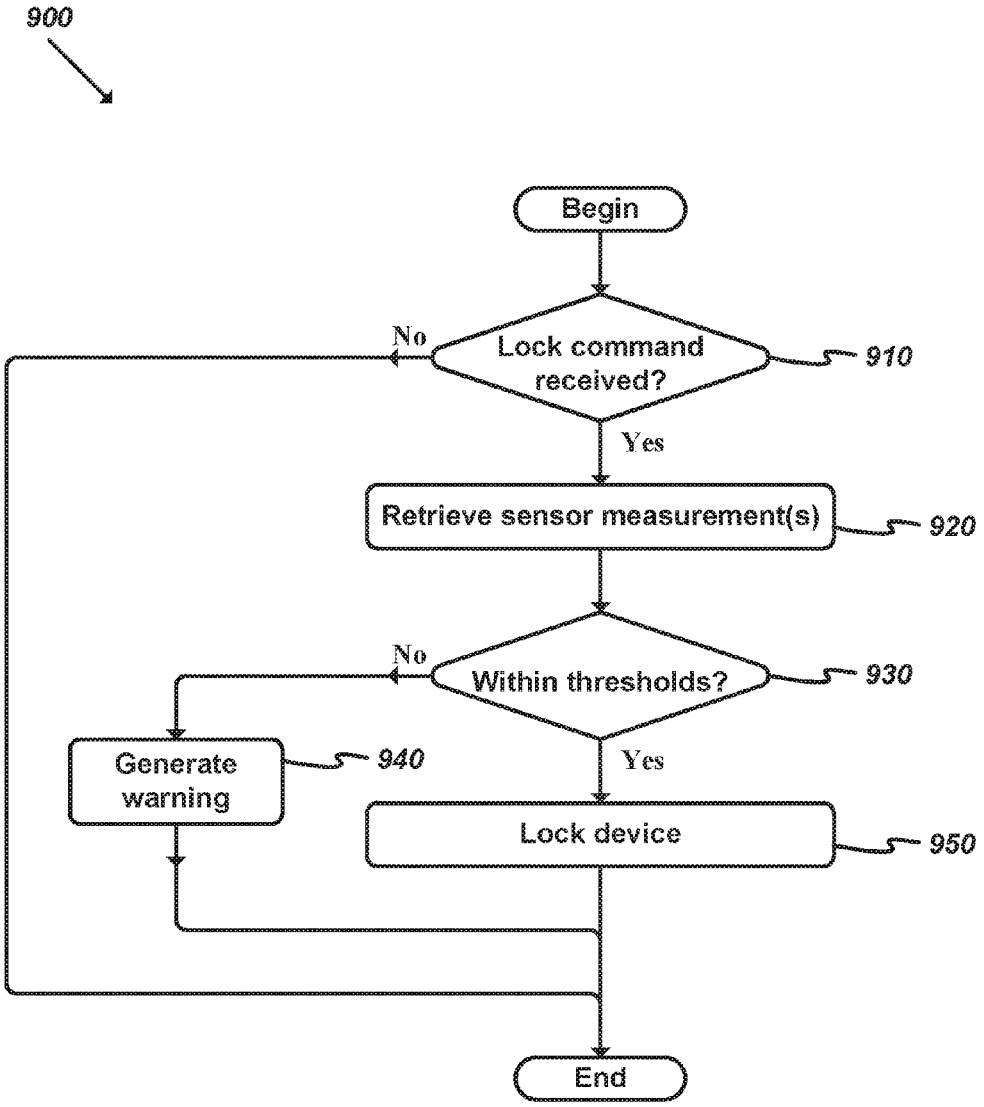
FIG. 9 illustrates a flow chart of an exemplary process that seals a container using an automated stopper and opener of some embodiments.

FIG. 9 illustrates a flow chart of an exemplary process 900 that seals a container using an automated stopper and opener of some embodiments. The process may be executed by a device such as device 810. Such a process may begin, for instance, when a device such as device 810 is powered on, when a connection to a user device is made, and/or under other appropriate conditions.

As shown, the process may determine (at 910) whether a lock command has been received. Such a command may be received in various appropriate ways (e.g., as a message received over a wireless link, as a user manipulates a user interface elements such as a pushbutton, etc.).

If the process determines (at 910) that no lock command has been received, the process may end.

If the process determines (at 910) that a lock command has been received, the process may then retrieve (at 920) sensors measurements, if available and/or appropriate. Such measurements may include, for instance, pressure applied to the inside surface of a container.

Next, the process may determine (at 930) whether the sensor measurements are within allowable thresholds. Such thresholds may indicate, for instance, a maximum allowable internal pressure of the container.

If the process determines (at 930) that the measurements are not within allowable thresholds, the process may generate (at 940) a warning and then may end. Such a warning may include, for instance, a message sent to a user device, a light or other visual indicator, a sound or audio indication, etc.

If the process determines (at 930) that the measurements are within allowable thresholds, the process may lock (at 950) the device and then may end. Such locking may include, for instance, activating a motor to rotate a threaded member such that a nut is moved along a linear axis within a guide as described above.

In some embodiments a sealing process may be performed by another device or component than the automated stopper and opener. For instance, without activating the stopper and opener, the stopper and opener may be physically inserted into a container (e.g., by using a press), while in a locked position.

Figure 10:
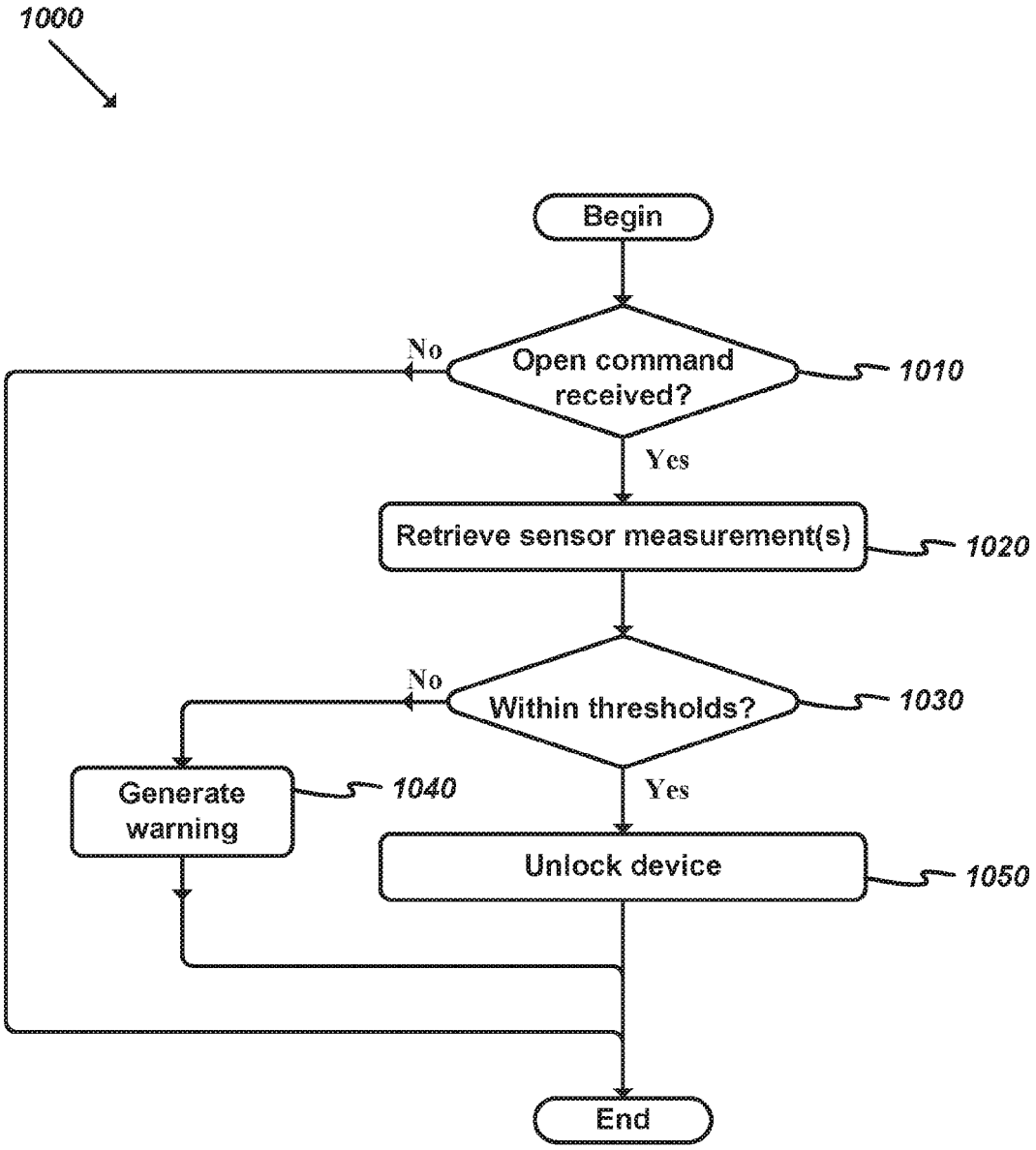
FIG. 10 illustrates a flow chart of an exemplary process that opens a container using an automated stopper and opener of some embodiments.

FIG. 10 illustrates a flow chart of an exemplary process 1000 that opens a container using an automated stopper and opener of some embodiments. The process may be executed by a device such as device 810. Such a process may begin, for instance, when a device such as device 810 is powered on, when a connection to a user device is made, and/or under other appropriate conditions (e.g., when a foil wrap is removed).

As shown, the process may determine (at 1010) whether an open command has been received. Such a command may be received in various appropriate ways (e.g., as a message received over a wireless link, as a user manipulates a user interface elements such as a pushbutton, etc.).

If the process determines (at 1010) that no open command has been received, the process may end.

If the process determines (at 1010) that an open command has been received, the process may then retrieve (at 1020) sensors measurements, if available and/or appropriate. Such measurements may include, for instance, pressure applied to the inside surface of a container.

Next, the process may determine (at 1030) whether the sensor measurements are within allowable thresholds. Such thresholds may indicate, for instance, a maximum allowable internal pressure of the container.

If the process determines (at 1030) that the measurements are not within allowable thresholds, the process may generate (at 1040) a warning and then may end. Such a warning may include, for instance, a message sent to a user device, a light or other visual indicator, a sound or audio indication, a failure to perform the open operation, etc.

If the process determines (at 1030) that the measurements are within allowable thresholds, the process may unlock (at 1050) the device and then may end. Such unlocking may include, for instance, activating a motor to rotate a threaded member such that a nut is moved along a linear axis within a guide as described above.

For certain beverages, such as sparkling wine or Champagne, the pressure of the contents may cause the stopper and opener of some embodiments to be expelled after unlocking. In this way, Champagne corks, for instance, may be "popped" automatically by sending an open command to the stopper and opener without any further intervention needed.

One of ordinary skill in the art will recognize that processes 900 and 1000 may be implemented in various different ways without departing from the scope of the disclosure. For instance, the various operations may be performed in a different order, additional operations may be included, and/or listed operations may be omitted. In addition, various operations and/or groups of operations may be performed iteratively and/or based on some criteria. For instance, process 900 and process 1000 may be performed serially and iteratively as a container is sealed, opened, resealed, etc. As another example, either process may be broken into multiple sub-processes and/or included within a larger macro process.

In addition, various other usage scenarios may be enabled by such processes. For instance, some embodiments may include temperature sensors. A user may be able to retrieve readings from one or more containers for various purposes. For example, a user may monitor wine bottles in a wine cellar and receive an alert if the measured temperature is outside of a specified range. As another example, a user may put warm beverages into a refrigerator and receive an alert when the temperature of the beverages falls below a specified threshold. Other such scenarios may include determining breakage during shipment or storage (e.g., based on pressure measurements), monitoring storage positions and/or changes in position (e.g., to determine whether wine bottles are being stored in a proper orientation and/or being rotated at regular intervals to maintain quality), monitoring stored beverages such as beer to determine whether a freshness threshold has been reached (e.g., by monitoring time elapsed since bottling, by measuring some chemical characteristic of the stored liquids, etc.).

V. Computer System

Many of the processes and modules described above may be implemented as software processes that are specified as one or more sets of instructions recorded on a non-transitory storage medium. When these instructions are executed by one or more computational element(s) (e.g., microprocessors, microcontrollers, digital signal processors (DSPs), application-specific integrated circuits (ASICs), field programmable gate arrays (FPGAs), etc.) the instructions cause the computational element(s) to perform actions specified in the instructions.

In some embodiments, various processes and modules described above may be implemented completely using electronic circuitry that may include various sets of devices or elements (e.g., sensors, logic gates, analog to digital converters, digital to analog converters, comparators, etc.). Such circuitry may be able to perform functions and/or features that may be associated with various software elements described throughout.

Figure 11:
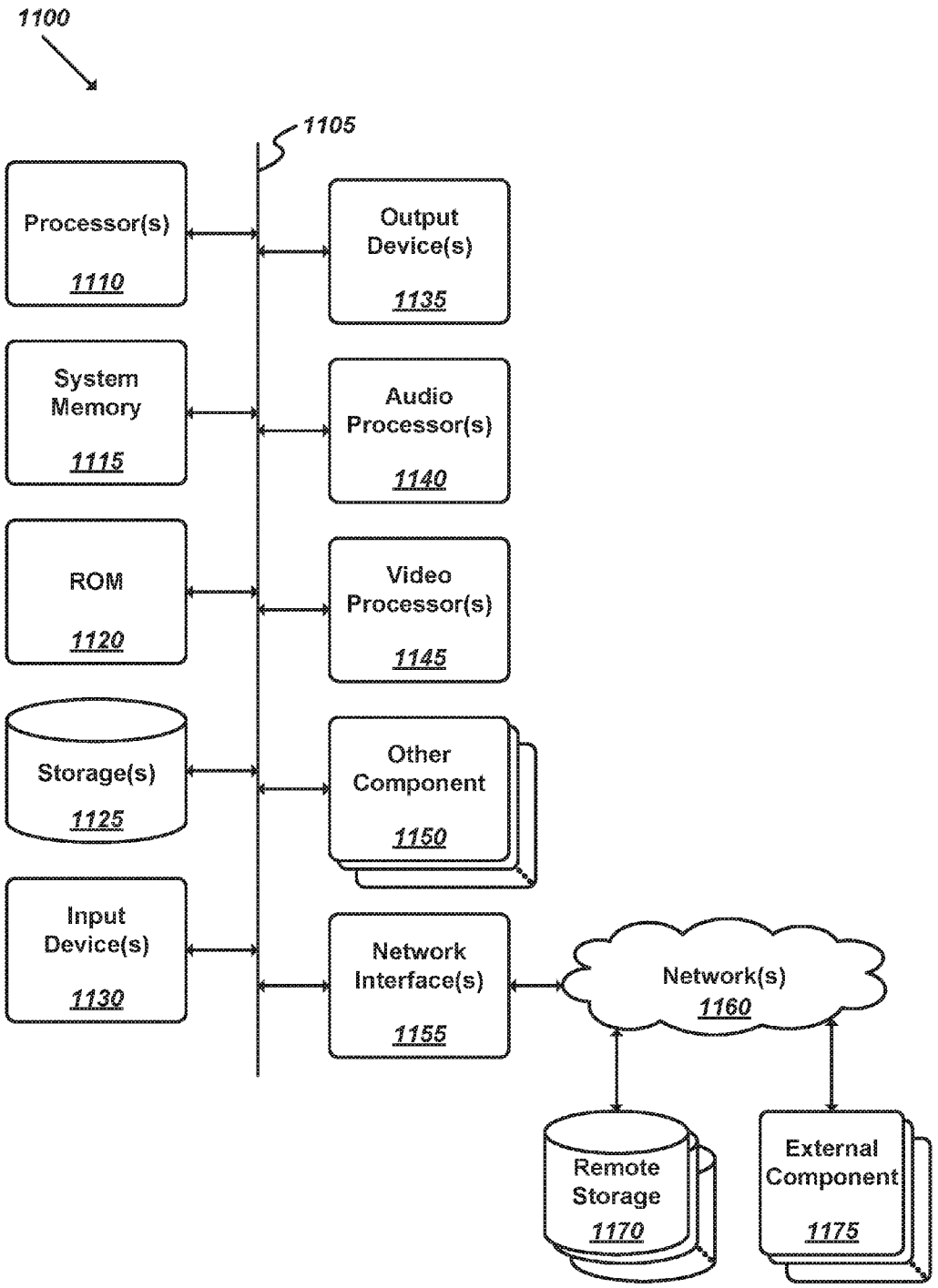
FIG. 11 illustrates a schematic block diagram of an exemplary computer system used to implement some embodiments.

FIG. 11 illustrates a schematic block diagram of an exemplary computer system 1100 used to implement some embodiments. For example, the system described above in reference to FIG. 8 may be at least partially implemented using computer system 1100. As another example, the processes described in reference to FIGS. 9-10 may be at least partially implemented using sets of instructions that are executed using computer system 1100.

Computer system 1100 may be implemented using various appropriate devices. For instance, the computer system may be implemented using one or more personal computers (PCs), servers, mobile devices (e.g., a smartphone), tablet devices, and/or any other appropriate devices. The various devices may work alone (e.g., the computer system may be implemented as a single PC) or in conjunction (e.g., some components of the computer system may be provided by a mobile device while other components are provided by a tablet device).

As shown, computer system 1100 may include at least one communication bus 1105, one or more processors 1110, a system memory 1115, a read-only memory (ROM) 1120, permanent storage devices 1125, input devices 1130, output devices 1135, audio processors 1140, video processors 1145, various other components 1150, and one or more network interfaces 1155.

Bus 1105 represents all communication pathways among the elements of computer system 1100. Such pathways may include wired, wireless, optical, and/or other appropriate communication pathways. For example, input devices 1130 and/or output devices 1135 may be coupled to the system 1100 using a wireless connection protocol or system.

The processor 1110 may, in order to execute the processes of some embodiments, retrieve instructions to execute and/or data to process from components such as system memory 1115, ROM 1120, and permanent storage device 1125. Such instructions and data may be passed over bus 1105.

System memory 1115 may be a volatile read-and-write memory, such as a random access memory (RAM). The system memory may store some of the instructions and data that the processor uses at runtime. The sets of instructions and/or data used to implement some embodiments may be stored in the system memory 1115, the permanent storage device 1125, and/or the read-only memory 1120. ROM 1120 may store static data and instructions that may be used by processor 1110 and/or other elements of the computer system.

Permanent storage device 1125 may be a read-and-write memory device. The permanent storage device may be a non-volatile memory unit that stores instructions and data even when computer system 1100 is off or unpowered. Computer system 1100 may use a removable storage device and/or a remote storage device as the permanent storage device.

Input devices 1130 may enable a user to communicate information to the computer system and/or manipulate various operations of the system. The input devices may include keyboards, cursor control devices, audio input devices and/or video input devices. Output devices 1135 may include printers, displays, audio devices, etc. Some or all of the input and/or output devices may be wirelessly or optically connected to the computer system 1100.

Audio processor 1140 may process and/or generate audio data and/or instructions. The audio processor may be able to receive audio data from an input device 1130 such as a microphone. The audio processor 1140 may be able to provide audio data to output devices 1140 such as a set of speakers. The audio data may include digital information and/or analog signals. The audio processor 1140 may be able to analyze and/or otherwise evaluate audio data (e.g., by determining qualities such as signal to noise ratio, dynamic range, etc.). In addition, the audio processor may perform various audio processing functions (e.g., equalization, compression, etc.).

The video processor 1145 (or graphics processing unit) may process and/or generate video data and/or instructions. The video processor may be able to receive video data from an input device 1130 such as a camera. The video processor 1145 may be able to provide video data to an output device 1140 such as a display. The video data may include digital information and/or analog signals. The video processor 1145 may be able to analyze and/or otherwise evaluate video data (e.g., by determining qualities such as resolution, frame rate, etc.). In addition, the video processor may perform various video processing functions (e.g., contrast adjustment or normalization, color adjustment, etc.). Furthermore, the video processor may be able to render graphic elements and/or video.

Other components 1150 may perform various other functions including providing storage, interfacing with external systems or components, etc.

Finally, as shown in FIG. 11, computer system 1100 may include one or more network interfaces 1155 that are able to connect to one or more networks 1160. For example, computer system 1100 may be coupled to a web server on the Internet such that a web browser executing on computer system 1100 may interact with the web server as a user interacts with an interface that operates in the web browser. Computer system 1100 may be able to access one or more remote storages 1170 and one or more external components 1175 through the network interface 1155 and network 1160. The network interface(s) 1155 may include one or more application programming interfaces (APIs) that may allow the computer system 1100 to access remote systems and/or storages and also may allow remote systems and/or storages to access computer system 1100 (or elements thereof).

As used in this specification and any claims of this application, the terms "computer", "server", "processor", and "memory" all refer to electronic devices. These terms exclude people or groups of people. As used in this specification and any claims of this application, the term "non-transitory storage medium" is entirely restricted to tangible, physical objects that store information in a form that is readable by electronic devices. These terms exclude any wireless or other ephemeral signals.

It should be recognized by one of ordinary skill in the art that any or all of the components of computer system 1100 may be used in conjunction with some embodiments. Moreover, one of ordinary skill in the art will appreciate that many other system configurations may also be used in conjunction with some embodiments or components of some embodiments.

In addition, while the examples shown may illustrate many individual modules as separate elements, one of ordinary skill in the art would recognize that these modules may be combined into a single functional block or element. One of ordinary skill in the art would also recognize that a single module may be divided into multiple modules.

The foregoing relates to illustrative details of exemplary embodiments and modifications may be made without departing from the scope of the disclosure as defined by the following claims.

We claim:

1. An automated stopper and opener comprising:

a sleeve housing that is able to fit within a neck of a container;

a mechanical feature that is able to vary a force applied to an internal surface of the sleeve housing such that a seal is able to be formed or released within the neck of the container, wherein the mechanical feature comprises: a cylindrical guide able to fit within the sleeve housing; a nut able to move along a linear axis of the cylindrical guide; a threaded member that controls a position of the nut along the linear axis; and a motor that is able to rotate the threaded member; and an electronic controller that is able to manipulate the force applied to the internal surface of the sleeve housing by at least partly directing operations of the mechanical feature.

2. The automated stopper and opener of claim 1, wherein the sleeve housing comprises at least one of cork, rubber, and plastic.

3. The automated stopper and opener of claim 1, wherein the container is one of a wine bottle and a champagne bottle.

4. The automated stopper and opener of claim 1 further comprising a communication interface communicatively coupled to the electronic controller that is able to wirelessly communicate with at least one external device such that the at least one external device may be able to at least partly direct operations of the electronic controller.

5. The automated stopper and opener of claim 1 further comprising a set of sensors communicatively coupled to the electronic controller, the set of sensors able to measure at least one attribute associated with the container.

6. The automated stopper and opener of claim 1 further comprising at least one user interface element communicatively coupled to the electronic controller, wherein the user interface element that is able to be used to at least partly control operations of the electronic controller.

7. An automated stopper comprising:

a cylindrical sleeve;

a mechanical element that fits within the cylindrical sleeve and has a variable outer diameter;

a communication interface that is able to receive commands from a user device; and a controller that is able to interpret the received commands and direct the mechanical element in order to control the variable outer diameter, wherein the mechanical element comprises:

a cylindrical guide able to fit within the cylindrical sleeve;

a nut able to move along a linear axis of the cylindrical guide;

a threaded member that controls a position of the nut along the linear axis; and a motor that is able to rotate the threaded member.

8. The automated stopper of claim 7, wherein the cylindrical sleeve comprises at least one of cork, plastic, and rubber.

9. The automated stopper of claim 7, wherein the commands include an "open" command and a "close" command.

10. The automated stopper of claim 9, wherein the "open" command is associated with a reduction in the outer diameter of the mechanical element and the "close" command is associated with an increase in the outer diameter of the mechanical element.

11. The automated stopper of claim 7, wherein the communication interface is able to communicate with the user device using at least one of a Bluetooth link, a Wi-Fi channel, and a cellular link.

12. The automated stopper of claim 7 further comprising at least one sensor that is able to measure a parameter associated with contents of a container housing the automated stopper.

13. The automated stopper of claim 7, wherein the cylindrical sleeve is sized to fit within a neck of a wine bottle or champagne bottle.

14. A system for opening a set of beverage containers, the system comprising:

a user device able to communicate across at least one wireless pathway; and a plurality of beverage containers, each beverage container having an automated stopper comprising:

a cylindrical sleeve;

a mechanical element that fits within the cylindrical sleeve and has a variable outer diameter;

a communication interface that is able to receive commands from the user device; and a controller that is able to interpret the received commands and direct the mechanical element in order to control the variable outer diameter, wherein the mechanical element comprises:

a cylindrical guide able to fit within the cylindrical sleeve;

a nut able to move along a linear axis of the cylindrical guide;

a threaded member that controls a position of the nut along the linear axis; and a motor that is able to rotate the threaded member.

15. The system of claim 14, wherein the user device is one of a smartphone, tablet, laptop, and server.

16. The system of claim 14, wherein the plurality of beverage containers comprises at least one of a champagne bottle, a wine bottle, a beer bottle, a water bottle, and a soda bottle.

17. The system of claim 14, wherein the communication interface is able to communicate with the user device using at least one of a Bluetooth link, a Wi-Fi channel, and a cellular link.

18. The system of claim 14, wherein the received command comprises an "open" command and the plurality of beverage containers comprises a plurality of champagne bottles.

19. The system of claim 14, wherein the automated stopper further comprises a set of sensors able to measure at least one attribute of a beverage stored in each beverage container and wherein the communication interface is able to send the measured attributes to the user device.

* * * * *